US006802148B1

(12) United States Patent
Danas

(10) Patent No.: US 6,802,148 B1
(45) Date of Patent: Oct. 12, 2004

(54) TARGET GRIP APPARATUS FOR A FIREARM

(76) Inventor: Gregory A. Danas, 164 Andover St., Lowell, MA (US) 01852

( * ) Notice: Subject to any disclaimer, the term of this patent is extended or adjusted under 35 U.S.C. 154(b) by 0 days.

(21) Appl. No.: 10/404,930

(22) Filed: Apr. 1, 2003

(51) Int. Cl.[7] ..... F41C 23/00
(52) U.S. Cl. ..... 42/72; 42/71.02
(58) Field of Search ..... 42/72, 71.02

(56) References Cited

U.S. PATENT DOCUMENTS

| | | | | | |
|---|---|---|---|---|---|
| 297,412 | A | * | 4/1884 | Kelton | 42/71.02 |
| 628,356 | A | * | 7/1899 | Renwick | 42/63 |
| 694,969 | A | * | 3/1902 | Kemp | 42/59 |
| RE20,456 | E | * | 7/1937 | McClarin | 42/71.02 |
| 2,997,924 | A | * | 8/1961 | Rosebush | 89/155 |
| 3,128,571 | A | * | 4/1964 | Herrett | 42/71.02 |
| D252,694 | S | * | 8/1979 | Schiermeier | D22/108 |
| 4,936,036 | A | | 6/1990 | Sniezak et al. | 42/71.02 |
| 4,998,367 | A | * | 3/1991 | Leibowitz | 42/71.02 |
| 5,231,237 | A | | 7/1993 | Cupp | 42/71.02 |
| 5,406,731 | A | * | 4/1995 | Stevens | 42/71.02 |
| D374,903 | S | * | 10/1996 | Pearce | D22/108 |
| 5,560,133 | A | * | 10/1996 | Kuebler | 42/69.01 |
| 5,621,997 | A | | 4/1997 | Pearce | 42/71.02 |
| 5,797,207 | A | * | 8/1998 | Marable et al. | 42/71.02 |
| 6,112,446 | A | | 9/2000 | Forster et al. | 42/71.02 |

* cited by examiner

*Primary Examiner*—Michael J. Carone
*Assistant Examiner*—M. Thomson
(74) *Attorney, Agent, or Firm*—Pearson & Pearson, LLP

(57) ABSTRACT

A target grip for a firearm comprising insertable and removable trigger finger support inserts for a side panel of the grip for enabling the distal portion of a user's trigger finger to contact a trigger perpendicular to the trigger for more shooting accuracy and consistency. Various size trigger finger target grip extender inserts may be inserted into the firearm grip and removed until the proper size insert is found. The target grip extender insert is secured by a friction fit or by a clip on the end of the insert.

10 Claims, 8 Drawing Sheets

TARGET GRIP APPARATUS FOR A FIREARM

BACKGROUND OF THE INVENTION

1. Field of the Invention

This invention relates to a firearm grip and in particular to a pistol target grip comprising insertable and removable trigger finger support inserts on a side panel of the body of the firearm grip.

2. Description of Related Art

Many types of grips have been devised for attachment to firearms or pistols to enable a user to better hold and aim the firearm, or to reduce recoil or otherwise improve the comfort when the firearm is held and fired with consistent accuracy. The use of elastomers in the grip assembly provides for a better "feel" in the user's hand and may provide a certain amount of bulk or sizing to otherwise standard factory produced grips. The following listed U.S. patents are examples of firearm grips.

U.S. Pat. No. 5,621,997 issued Apr. 22, 1997 to R. Lane Pearce and assigned to Pearce Grip, Inc. discloses a handgun grip enhancer for use with side panel grip type handguns. The grip enhancer includes a forward grip cushioning element or cross strap and right and left hand wing members forming side plates which fit under the regular handgun side panel grip elements. However, the handgun grip does not provide for adjusting the position of the trigger finger at a right angle to the trigger.

U.S. Pat. No. 6,112,446 issued Sep. 5, 2000 to Theobald Förster et al. and assigned to SIG Arms International AG, discloses a weapon grip comprising a grip body and grip shell having an approximately U-shaped cross section and being releasably and replaceably inserted on the grip body. However, the weapon grip does not provide for placement of a trigger finger with consistency on the weapon trigger.

U.S. Pat. No. 5,231,237 issued Jul. 27, 1993 to Carl J. Cupp and assigned to Pachmayr Ltd., of Monrovia, Calif., describes a cushioning grip assembly for a hand gun. The grip assembly includes a main body or chassis and two grip elements having outer surfaces formed of neoprene rubber or other deformable elastomeric material for providing cushioned contact with a user's hand in holding and firing the gun. One grip element is a forward grip unit and the second grip element is a back strap attachable to the body. However, this grip does not provide adjustment for positioning a trigger finger of a user.

U.S. Pat. No. 4,936,036 issued Jun. 26, 1990 to Bary A. Sniezak et al. and assigned to Smith & Wesson Corp. of Springfield, Mass. discloses an integral grip for the handle of a handgun frame molded from a resilient, flexible, synthetic plastic material. The grip is of generally U-shaped configuration including a curved rear wall and two spaced opposed sidewall portions. However, this integral grip does not provide any adjustment for positioning a trigger finger of a user.

None of the above patents disclose the structural features of the present invention, which is intended to be an after-market attachment replacing one of the standard factory side panels of a firearm to improve proper placement of the trigger finger on the trigger.

SUMMARY OF THE INVENTION

Accordingly, it is therefore an object of this invention to provide various size contoured grips attached to the frame of a firearm, enabling the user to improve target accuracy and consistency.

It is another object of this invention to provide a, left or right side panel on the frame of a pistol having an insert with a contoured outward extension to allow the trigger finger to be placed on the trigger allowing only the distal portion of a user's trigger finger to contact the trigger.

It is a further object of this invention to provide a contoured outward extension on a side panel insert of a firearm to enable the trigger finger to rest on the trigger from a direction approximately perpendicular to the trigger.

It is yet another object of the invention to provide a plurality of removable side panel inserts on a pistol, each of the inserts having a different size contoured outward extension for custom fitting the user's finger length and particularly positioning the distal portion of the trigger finger of the user to be approximately perpendicular to the trigger.

These and other objects are accomplished by a target grip for a firearm comprising a side panel attached to a frame of the firearm, the side panel comprises a varying contoured outward extension for a user's trigger finger to rest on in order to position a distal portion of the trigger finger directly in front of a trigger and approximately perpendicular to the trigger. The side panel comprises a removable insert for providing different size varying contoured outward extensions to match a particular user's trigger finger length thereby causing the positioning of the middle portion of the distal portion of the trigger finger directly in front of the trigger and approximately perpendicular to the trigger.

The objects are further accomplished by a target grip for a firearm comprising a side panel attached to a frame of the firearm, and a removable insert secured within the side panel, the insert having a contoured outward extension for a user's trigger finger to rest on the insert and to position a distal portion of the user's trigger finger adjacent to a trigger of the firearm and approximately perpendicular to the trigger. The removable insert, secured within the side panel, comprises edges which fit into channels of the side panel for a secure fit. The removable insert, secured within the side panel, comprises a tab located on an inner end of the insert for clipping inside the side panel. The removable insert comprises a predetermined contour of the outward extension to accommodate a specific size of the user's trigger finger. Further, a plurality of removable inserts are provided for the side panel, each of the removable inserts having a different outward extension to accommodate different lengths of various user's trigger fingers.

The objects are further accomplished by a method of providing a target grip for a firearm comprising the steps of attaching a side panel to a frame of the firearm, and securing a removable insert within the side panel, the insert having a contoured outward extension for a user's trigger finger to rest on the insert and to position a distal portion of the user's trigger finger adjacent to a trigger of the firearm and approximately perpendicular to the trigger. The method comprises the step of providing a predetermined contour of the outward extension of the removable insert to accommodate a specific length of the user's trigger finger. The method comprises the step of providing a plurality of removable inserts for the side panel, each of the removable inserts having a different size outward extension to accommodate different lengths of the user's trigger finger.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
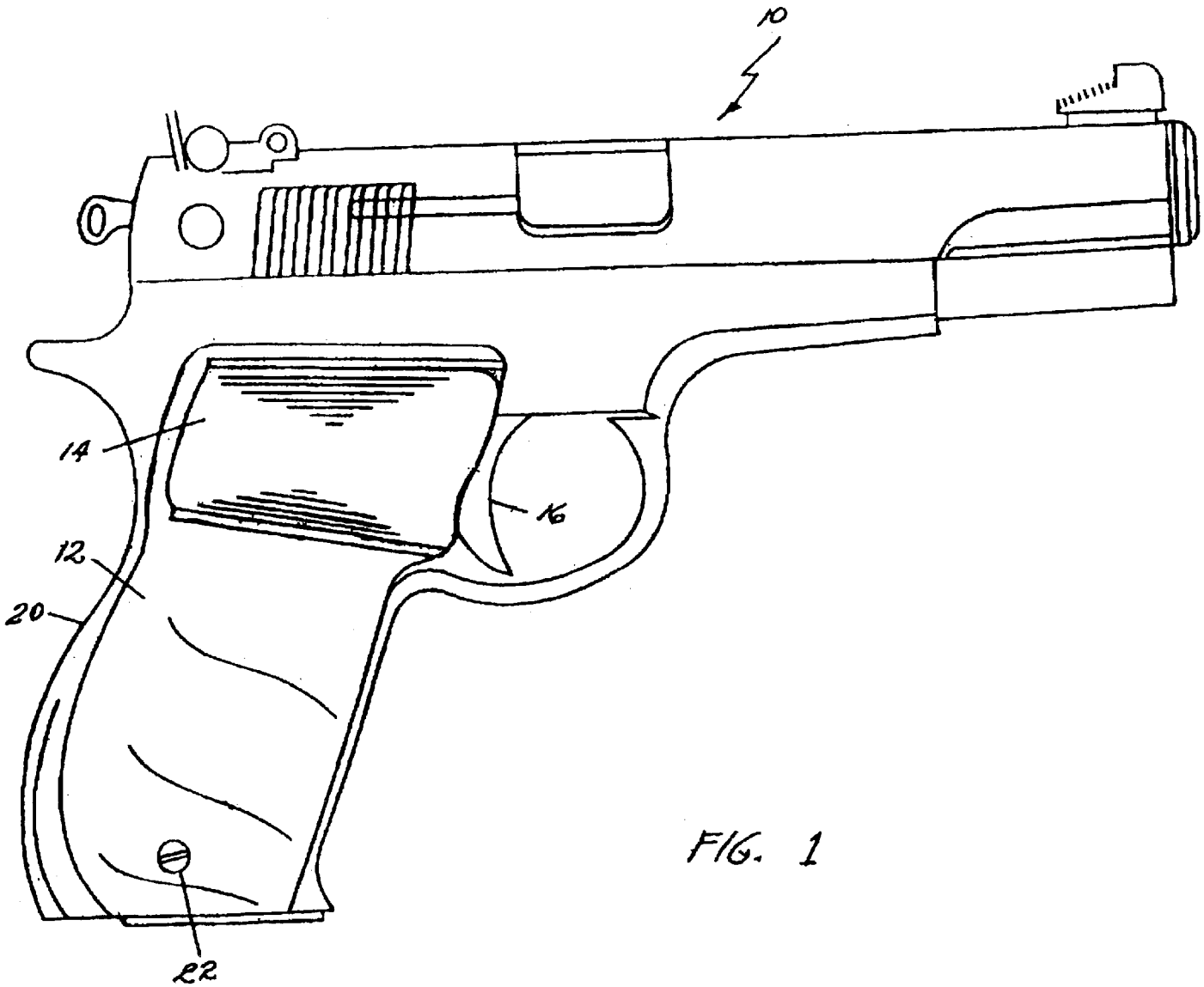
FIG. 1 is a side elevational view of a firearm target grip according to the present invention including a contoured trigger finger target grip extender insert for custom fitting of a user's trigger finger.

Referring to FIG. 1, a side elevational view of a firearm 10 according to the present invention is shown comprising a frame 20 having a side panel 12 with a trigger finger target grip extender insert 14 for custom fitting of a user's trigger finger approximately perpendicular to a trigger 16. The side panel 12 with the trigger finger target grip extender insert is lintended to replace a standard factory side panel of a firearm to improve placement of the user's trigger finger directly in front of the trigger 16. Several trigger finger target grip extender inserts 14 are provided with each side panel 12 to vary the placement of the distal end of a user's trigger finger and to enable the trigger finger to be placed in front of the trigger approximately perpendicular to the side of the trigger 16 of the firearm 10. The present invention may be used on handguns, revolvers, semiautomatic handguns, rifles, shotguns and any other firearm having a side panel 12 for receiving trigger finger target grip extender inserts 14.

Figure 2:
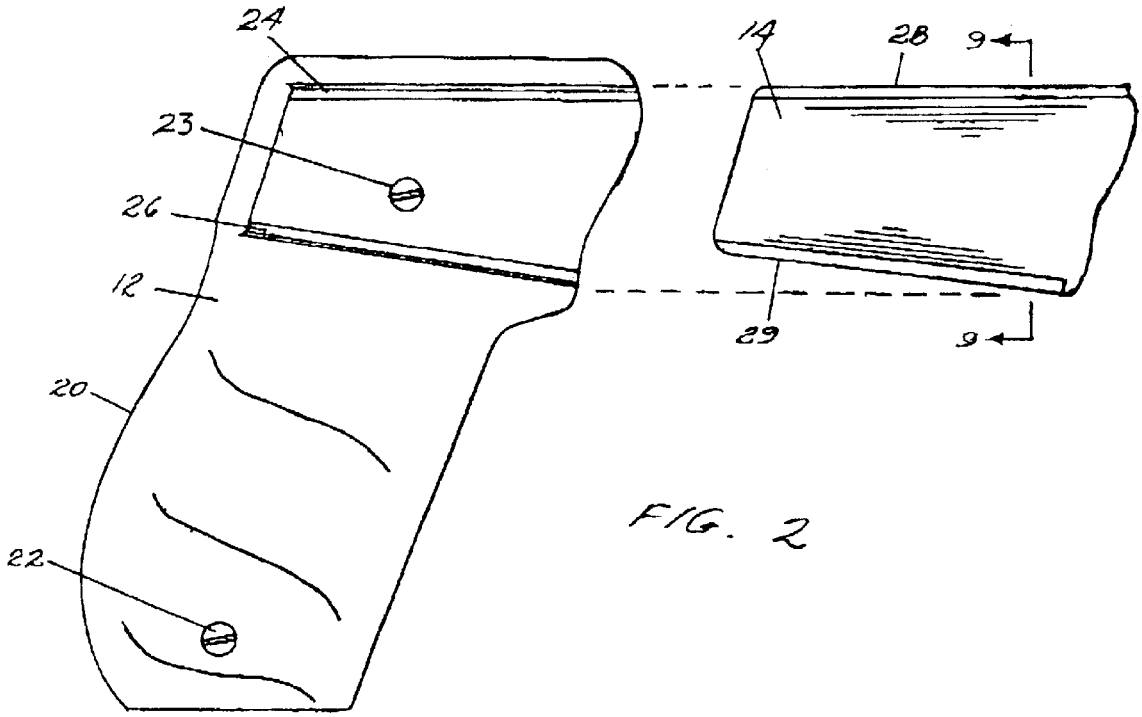
FIG. 2 is an exploded view of a first embodiment of a firearm right side panel having a trigger finger target grip extender insert.

Referring to FIG. 2, an exploded view of a first embodiment of the side panel 12 with trigger finger target grip extender insert 14 is shown comprising wings 28, 29 on the top and bottom edges of the insert 14 for mating with receiving channels 24, 26 on the side panel 12 and for guiding the insert 14 in and out of the side panel 12 and for securing the trigger finger target extender insert 14 within the side panel 12. The right side panel 12 is retained on the side of the frame 20 by two screws 22, 23.

Figure 9:
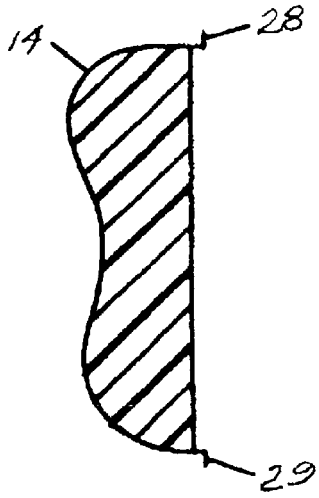
FIG. 9 is a cross-section of the trigger finger target grip extender insert of FIG. 2.

Referring to FIG. 9, a cross-sectional view is shown of the trigger finger target grip extender insert 14 with wings 28, 29 for mating with the receiving channels 24, 26 within the side panel 14.

Figure 3:
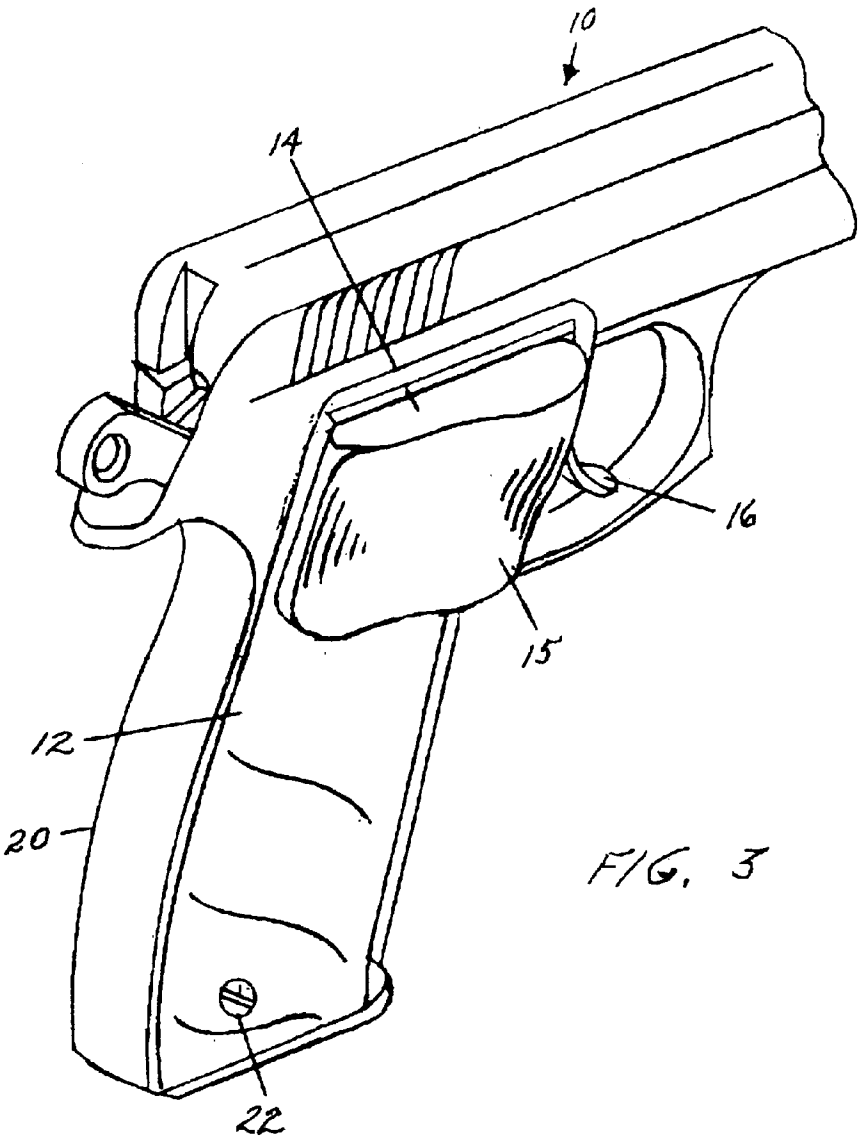
FIG. 3 is an isometric view of the trigger finger target grip having the extender insert on a side panel for positioning a right hand trigger finger perpendicular to a trigger.

Referring to FIG. 3, an isometric view of the side panel 12 is shown having the trigger finger target grip extender insert 14 for positioning a right hand trigger finger on the trigger 16. The side extension 15 is shown extending outward and toward the trigger 16 to enable the distal portion of the user's trigger finger to arrive at approximately a right angle to the side of the trigger 16 and in front of the trigger 16.

Figure 4:
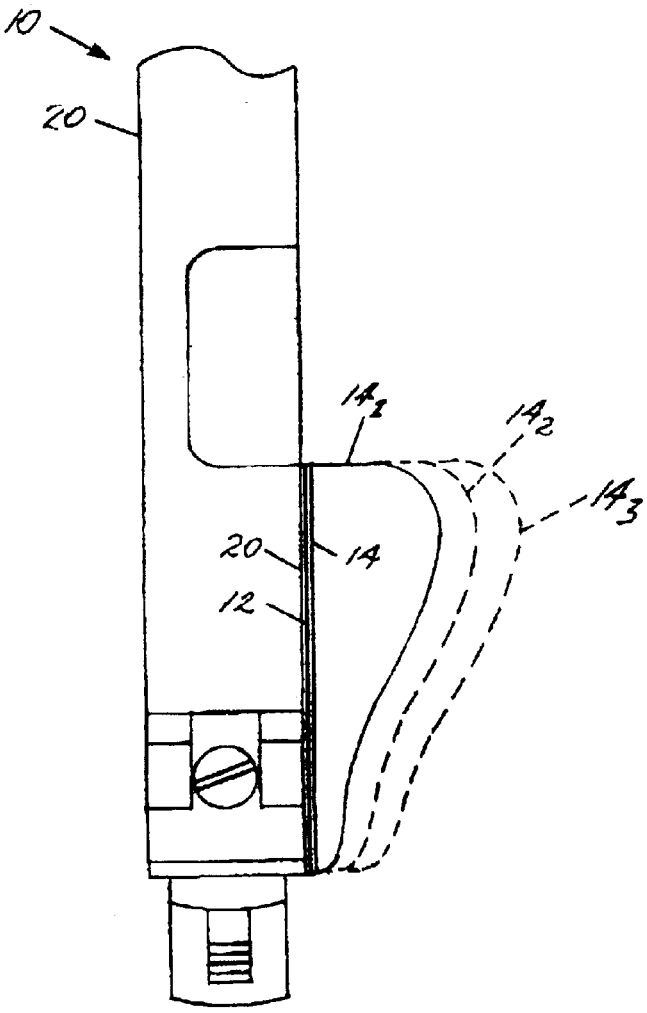
FIG. 4 is a top view of the firearm showing various size trigger finger target grip extender inserts for custom fitting of a user's right hand trigger finger.

Referring to FIG. 4, a top view of the firearm 10 is shown indicating various size trigger finger target grip extender inserts $\mathbf{14}_1$, $\mathbf{14}_2$, $\mathbf{14}_3$, are provided for custom fitting a user's right hand trigger finger distal portion to arrive at approximately a right angle to the side of the trigger 16 and in front of the trigger 16. In practice, each extender insert $\mathbf{14}_1$, $\mathbf{14}_2$, $\mathbf{14}_3$, is tried by the user until the correct fit is found for the distal portion of the trigger finger is perpendicular to and in front of the trigger 16.

Figure 5:
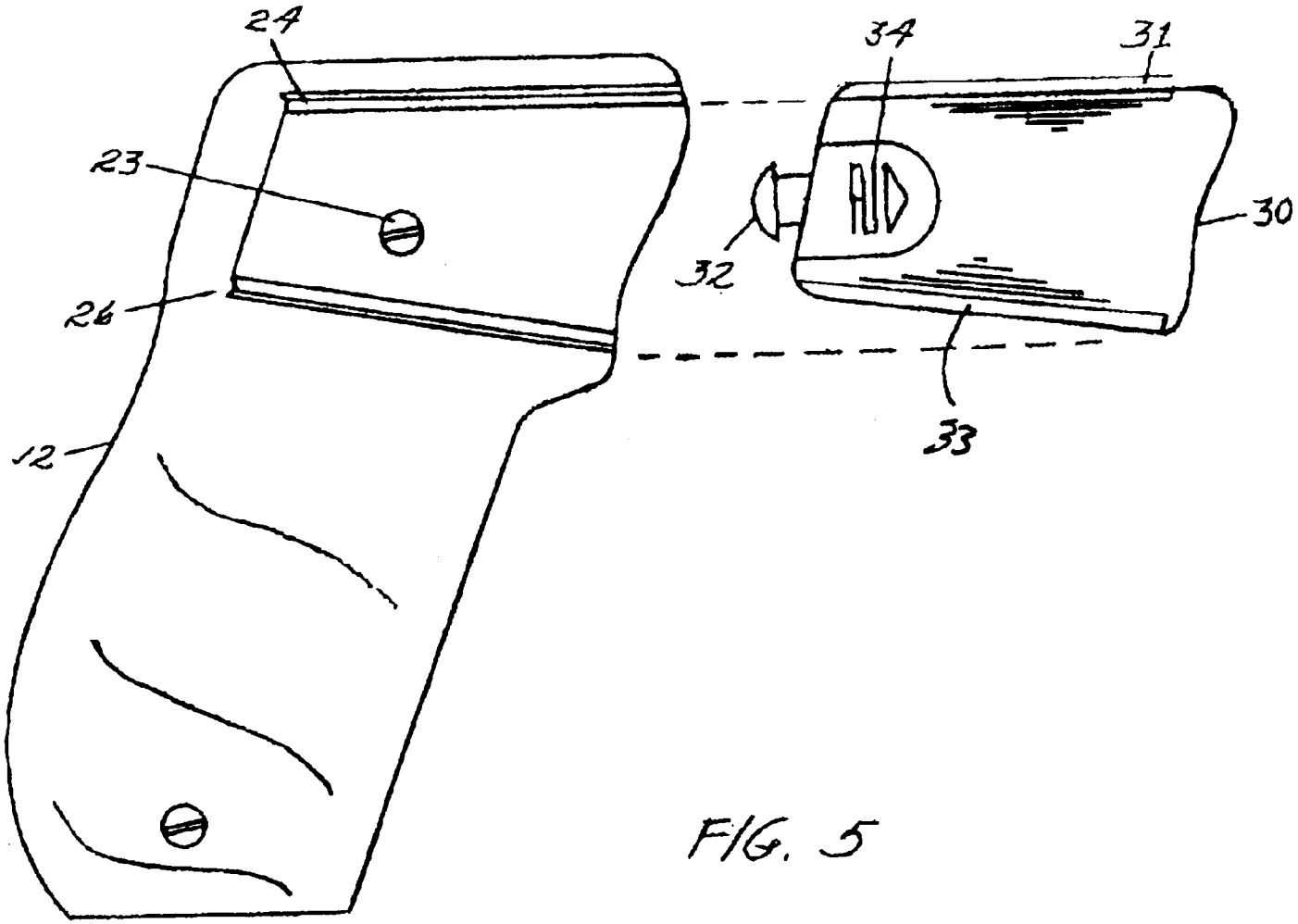
FIG. 5 is an exploded view of a second embodiment of a firearm right side panel having a trigger finger target grip extender insert.

Referring now to FIG. 5, an exploded view is shown of a second embodiment of a right side panel 12 having a target trigger grip extender insert 30 which comprises a clip 32 at one side and wings 31, 33 on the top and bottom of the extender insert 30 for insertion into channels 24, 26 of the side panel 12. The insert 30 slides from right to left and the clip 32 is secured within the side panel 12. Pressing on an embossed area 34 of the insert 30 causes the insert 30 to slide out for removal.

Figure 6:
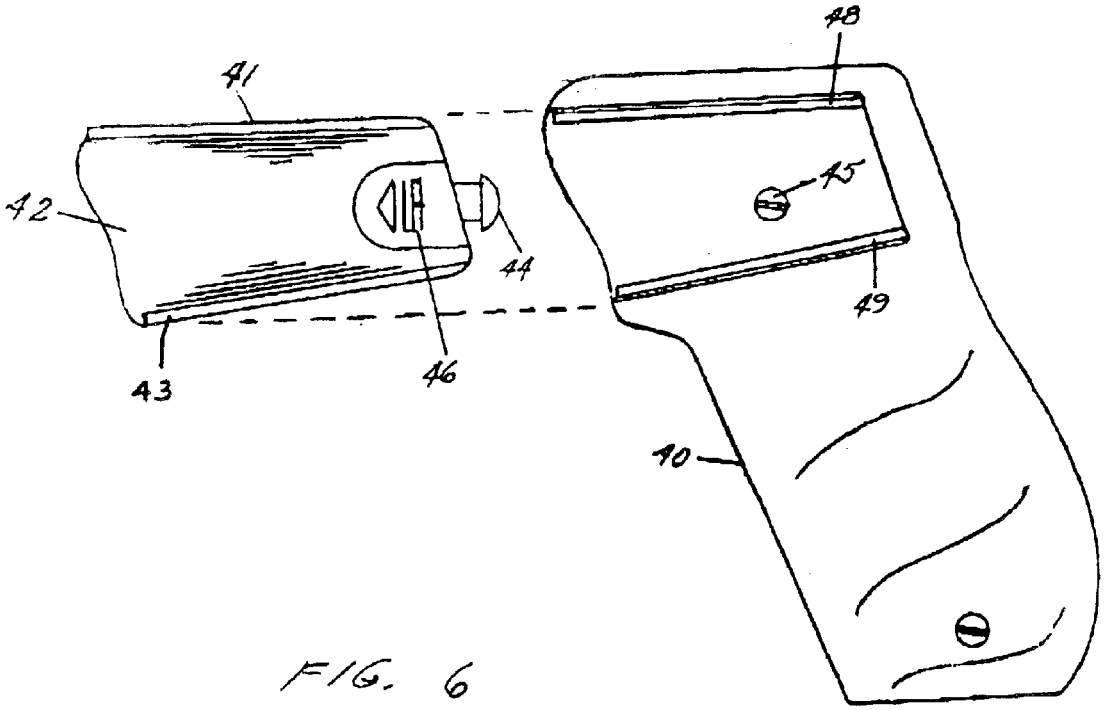
FIG. 6 is an exploded view of a third embodiment of a firearm left side panel having a trigger finger target grip extender insert.

Referring to FIG. 6, an exploded view is shown of a third embodiment of a left side panel 40 having a target grip extender insert 42 which comprises a clip 44 at one side and wings 41,43 on the top and bottom of the extender insert 42 for insertion into channels 48, 49. The insert 42 slides from left to right and the clip 44 is secured within the side panel 40. Pressing on an embossed area 46 of the insert 42 causes the insert 42 to slide out for removal.

Figure 7:
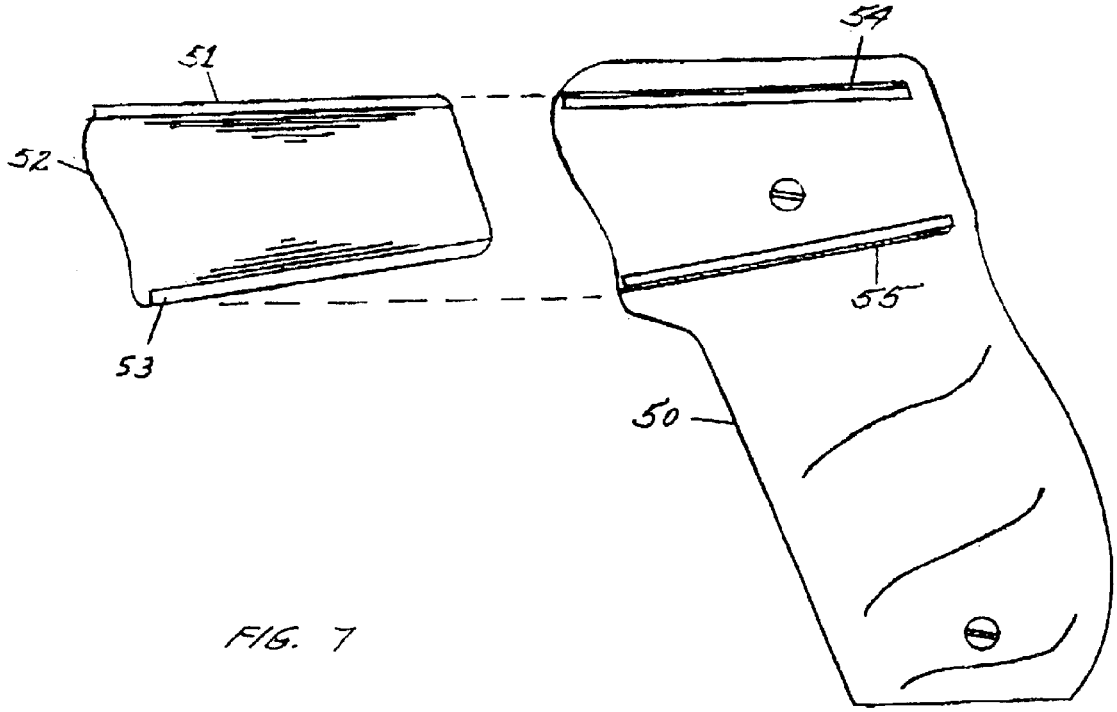
FIG. 7 is an exploded view of a fourth embodiment of a firearm left side panel having a trigger finger target grip extender insert.

Referring to FIG. 7, an exploded view is shown of a fourth embodiment of a left side panel 50 having a target trigger grip extender insert 52 comprising wings 51, 53 on the top and bottom edges of the insert 52 for mating with receiving channels 54, 55 on the side panel 50, for guiding insert 52 in and out of the side panel 50, and for securing the extender insert 52 within the side panel 50.

Figure 8:
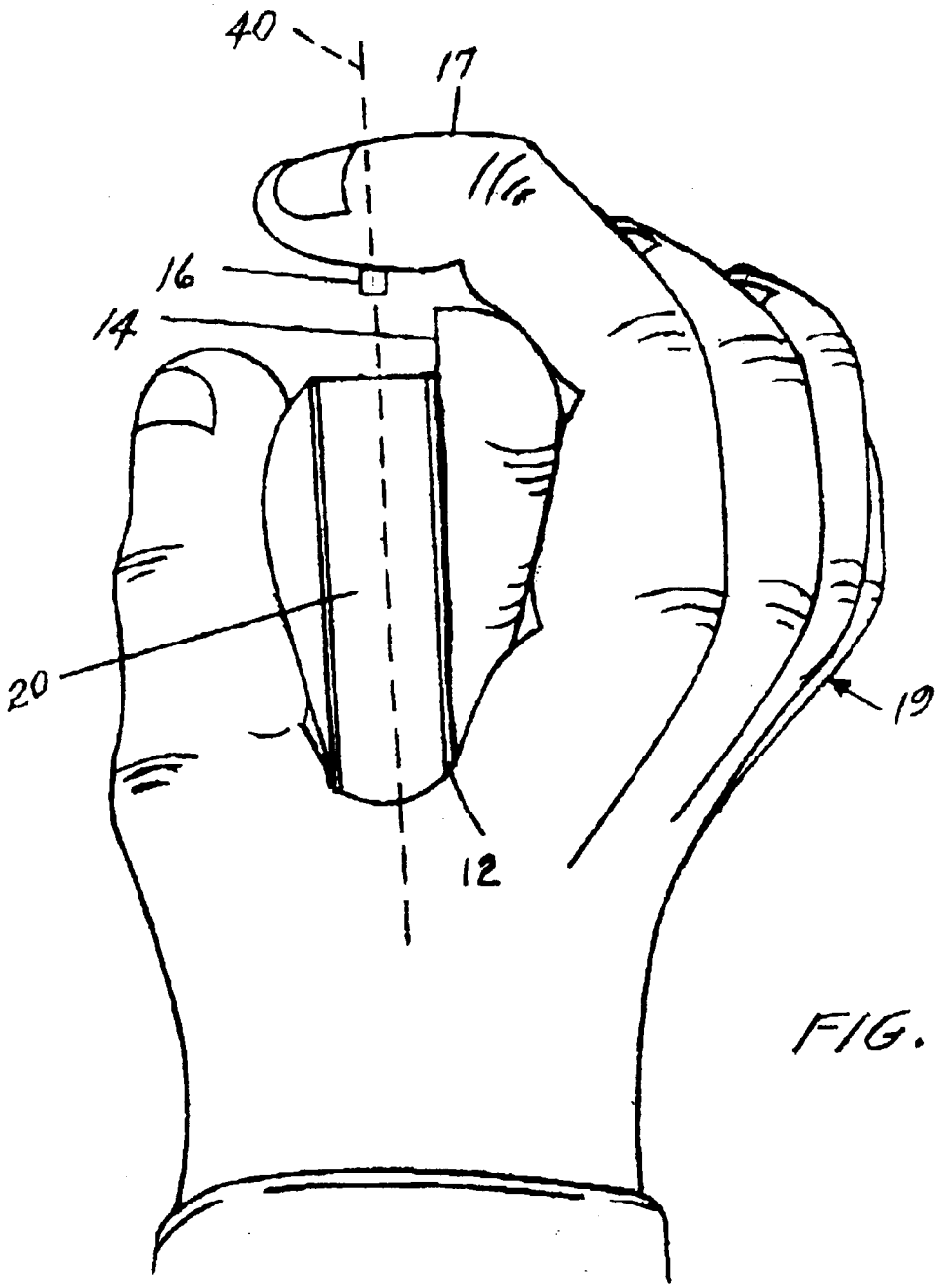
FIG. 8 is a top view of a section of the firearm having a contoured trigger finger target grip extender insert in a right side panel and showing the trigger finger of a user's hand positioned perpendicular to the trigger.

Referring to FIG. 8, a top view of a section of the frame 20, having a contoured target trigger grip extender insert 14 attached to the right side of frame 20, shows the trigger finger 17 supported by the extender insert 14 and the distal portion of the trigger finger 17 positioned perpendicular to the side of trigger 16 and in front of the trigger 16.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A target grip for a firearm comprising:

a side panel attached to a frame of said firearm, said side panel comprises a varying contoured outward extension for a user's trigger finger to rest on in order to position a distal portion of said trigger finger directly in front of a trigger and approximately perpendicular to said trigger; and a plurality of removable inserts are provided for insertion in said side panel, each of said removable inserts comprises a different size of said varying contoured outward extension to accommodate different lengths of said user's trigger finger.

2. The target grip as recited in claim 1 wherein each of said removable inserts, secured within said side panel, comprises edges which fit into channels of said side panel for a secure fit.

3. The target grip as recited in claim 1 wherein each of said removable inserts, secured within said side panel, comprises a tab located on an inner end of said removable insert for clipping inside said side panel.

4. The target grip as recited in claim 1 wherein each of said removable inserts is inserted into said side panel until said outward extension positions said user's trigger finger adjacent to said trigger of said firearm and approximately perpendicular to said trigger.

5. A target grip for a firearm comprising:

a side panel attached to a frame of said firearm; and a removable insert secured within said side panel, said removable insert comprises a contoured outward extension increasing in depth from a back edge to a front edge for an inside of a user's trigger finger to rest on said removable insert and for positioning a distal portion of said user's trigger finger adjacent to a trigger of said firearm and approximately perpendicular to said trigger.

6. The target grip as recited in claim 5 wherein said removable insert, secured within said side panel, comprises edges which fit into channels of said side panel for a secure fit.

7. The target grip as recited in claim 5 wherein said removable insert, secured within said side panel, comprises a tab located on said back edge of said removable insert for clipping inside said side panel.

8. The target grip as recited in claim 5 wherein a plurality of removable inserts are provided for said side panel, each of said removable inserts having a different size outward extension to accommodate different lengths of said user's trigger finger.

9. A method of providing a target grip for a firearm comprising the steps of:

attaching a side panel to a frame of said firearm;

securing a removable insert within said side panel, said removable insert having a contoured outward extension for a user's trigger finger to rest on said removable insert and to position a distal portion of said user's trigger finger adjacent to a trigger of said firearm and approximately perpendicular to said trigger; and providing a plurality of removable inserts for said side panel, each of said removable inserts comprising a different size outward extension to accommodate different lengths of said user's trigger finger.

10. The method as recited in claim 9 wherein said method comprises the step of inserting each of said removable inserts into said panel until said outward extension of said removable insert positions said distal portion of said user's trigger finger adjacent to said trigger of said firearm and approximately perpendicular to said trigger.

* * * * *